US012618316B2

(12) United States Patent
Younger et al.

(10) Patent No.: US 12,618,316 B2
(45) Date of Patent: May 5, 2026

(54) DOWNHOLE SAND TRAP

(71) Applicant: SAUDI ARABIAN OIL COMPANY, Dhahran (SA)

(72) Inventors: Rae Andrew Younger, Aberdeenshire (GB); Richard Mark Pye, Aberdeenshire (GB); Christopher Wrighton, Aberdeenshire (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 59 days.

(21) Appl. No.: 18/065,303

(22) Filed: Dec. 13, 2022

(65) Prior Publication Data

US 2024/0191609 A1 Jun. 13, 2024

(51) Int. Cl.

| | |
|---|---|
| ***E21B 43/34*** | (2006.01) |
| ***E21B 34/06*** | (2006.01) |
| ***E21B 43/02*** | (2006.01) |
| ***E21B 43/12*** | (2006.01) |

(52) U.S. Cl.

CPC ..... *E21B 43/35* (2020.05); *E21B 34/06* (2013.01); *E21B 43/02* (2013.01); *E21B 43/128* (2013.01); *E21B 2200/05* (2020.05)

(58) Field of Classification Search

CPC ..... E21B 43/35; E21B 43/02; E21B 43/128; E21B 34/06; E21B 2200/05

USPC ..... 166/316

See application file for complete search history.

(56) References Cited

U.S. PATENT DOCUMENTS

| | | | | |
|---|---|---|---|---|
| 8,584,744 | B2 * | 11/2013 | Soni | E21B 27/04 175/323 |
| 10,082,014 | B2 * | 9/2018 | Fielder, III | E21B 43/128 |
| 10,273,772 | B2 * | 4/2019 | Mericas | E21B 21/002 |
| 2012/0061073 | A1 * | 3/2012 | Soni | E21B 27/00 166/99 |

(Continued)

FOREIGN PATENT DOCUMENTS

WO 2019211600 A1 11/2019

OTHER PUBLICATIONS

J Tonkin; "What to do about High TSS Values a.k.a Sandy Boreholes", Dec. 12, 2022; pp. 1-9; Retrieved from the Internet: URL: https://bwa.co.za/the-borehole-water-journal/2017/11/12/what-to-do-about-sandy-boreholes (9 pages).

(Continued)

*Primary Examiner* — Tara Schimpf
*Assistant Examiner* — Patrick F Lambe
(74) *Attorney, Agent, or Firm* — Osha Bergman Watanabe & Burton LLP

(57) ABSTRACT

A solids trap module for an electrical submersible pump (ESP) of a wellbore is provided. The module includes a solids buffer and a fluid passage, the fluid passage having a first segment configured to redirect a fluid in a first angular direction relative to an axial axis, and a second segment configured to redirect at least a portion of the redirected fluid flow in a second angular direction different than the first angular direction. The first segment, the second segment, and the solids buffer are configured to cooperate to cause settling of solids entrained by the fluid flowing through the solids trap module during a period when the ESP does not operate and to re-entrain settled solids into the fluid flowing through the solids trap module when the ESP is operating.

12 Claims, 6 Drawing Sheets

(56) References Cited

U.S. PATENT DOCUMENTS

| | | | | |
|---|---|---|---|---|
| 2019/0003296 | A1 | 1/2019 | Fielder, III et al. | |
| 2019/0360302 | A1* | 11/2019 | Nowitzki | F16K 3/085 |
| 2021/0180429 | A1 | 6/2021 | Brown et al. | |
| 2021/0324722 | A1 | 10/2021 | Xiao et al. | |
| 2022/0025738 | A1 | 1/2022 | Nowitzki et al. | |

OTHER PUBLICATIONS

International Search Report issued for corresponding international patent application No. PCT/US2023/083575, mailed Apr. 8, 2024 (5 pages).
Written Opinion issued for corresponding international patent application No. PCT/US2023/083575, mailed Apr. 8, 2024 (9 pages).

* cited by examiner

DOWNHOLE SAND TRAP

BACKGROUND

Various techniques for bringing liquids out of a subterranean wellbore to the surface of the Earth may be implemented, for example, artificial lift technology. Artificial lift technology may include, for example, a pump and associated components to assist in lifting the fluids up through the wellbore. As an example, production tubing associated with the wellbore may include one or more pumps to assist in lifting the fluids up the wellbore. The pump may be electrically operated and located submerged in the fluid at or near the bottom of the well. The pump system may use a surface or seabed power source to drive the submerged pump assembly. Alternatively, power for the pump may be provided at another location downhole in the well, such as a downhole fuel cell. These pump systems so configured are termed electric submersible pump (ESP) systems.

Fluid pumped through a wellbore may also contain suspended solids (e.g., sand, scale, and other solid media), which may be entrained in the fluid flow and lifted to the surface along with the pumped fluid. However, in certain circumstances, the solids may fall back towards the ESP, for example, when the operation of the ESP is interrupted. Solids within the unpumped fluid may fall out of suspension (e.g., due to gravity acting on the particles), and reverse flow may also occur when the fluid column 'back-flows' or reverse-drives the unpowered ESP. This may cause the fluid column to flow back through the ESP.

The mass flow rate of fluid falling back through the unpowered ESP might be a fraction of the mass flow rate when the ESP is operating under power—the falling column of back-flowing fluid is moving slower than when the fluid is pumped by the ESP to surface, thereby further causing solids to settle out of the fluid and fall toward the ESP.

Solids arriving at the ESP may sufficiently accumulate to block or otherwise impede the ESP when pumping resumes. If sufficient solids accumulate then the ESP may become inoperable, potentially entraining expensive remedial repair.

Some well systems have implemented passive and/or active mechanisms two attempt to limit or stop solids from arriving at the ESP. However, in such systems, the solids falling out of suspension in the stationary fluid column may ultimately impede operation of the mechanism intended to prevent the solids from reaching the ESP, thereby entraining additional cost to repair the mechanism.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a solids trap module for an electrical submersible pump (ESP) of a wellbore. The solids trap module includes a solids buffer and a fluid passage having a first segment configured to redirect a fluid flowing through the solids trap in a first angular direction relative to an axial axis of the solids trap to form a redirected fluid flow, and a second segment configured to redirect at least a portion of the redirected fluid flow in a second angular direction different than the first angular direction to pass over at least a portion of the solids buffer. The first segment, the second segment, and the solids buffer are configured to cooperate to cause settling of solids entrained by the fluid flowing through the solids trap module during a period when the ESP does not operate and to re-entrain settled solids into the fluid flowing through the solids trap when the ESP is operating.

A first cross-sectional area of the second segment at a first point nearest the axial axis of the solids trap module may be smaller than a second cross-sectional area of the second segment at a second point furthest from the axial axis of the solids trap module.

A first cross-sectional area of the first segment at a first point nearest the axial axis of the solids trap module may be greater than a second cross-sectional area of the first segment at a second point furthest from the axial axis of the solids trap module.

The solids buffer may include a recess configured to accumulate settled solids.

The fluid passage may be defined by an inner surface of the solids trap module and an outer surface of a rounded cone having a spherical cap, and wherein a base of the rounded cone forms the solids buffer.

The solids trap module may include one or more spokes affixing the rounded cone to the inner surface of the solids trap module.

At least one of the one or more spokes may be configured to impart rotation to the fluid flowing through the solids trap module.

An external surface of the solids trap module may be configured to engage with an external surface of a second solids trap module to enable stacking of the solids trap module with another solids trap module.

The solids trap module may include a first register having a complementary shape to a register of the second solids trap module, and configured to concentrically align the solids trap module with the second solids trap module in a stacked configuration.

The solids trap module may include a geometric feature configured to angularly align the solids trap with another solids trap module.

The solids trap module may be unitarily formed by one of casting, injection molding, and three-dimensional printing.

According to further embodiments of the present disclosure, a solids trap module for a wellbore is provided. The solids trap module includes a body, a passage outer wall formed from a wall of the solids trap body and defining in part a fluid passage, a flow modifier presenting a tapered outer wall forming a passage inner wall of the fluid passage. A first distance between the passage inner wall and the passage outer wall at a bottom surface of the solids trap module is greater than a second distance between the passage inner wall and the passage outer wall at a base of the flow modifier, and the outer passage wall in combination with the base of the flow modifier forms a flow restriction in the fluid passage.

The base of the flow modifier may include a recessed portion forming a solids buffer configured to accumulate settled solids.

The flow restriction may be configured to direct at least a portion of a fluid flowing through the solids trap module over the base of the flow modifier.

The solids trap module may include one or more spokes affixing the flow modifier to the passage outer wall.

The base may include one or more surface modifiers configured to facilitate solids accumulation.

The one or more surface modifiers may include one or more of a chevron, a rib, a serration, and a dimple.

The passage outer wall may overlap at least a portion of the base of the flow modifier.

According to still further embodiments, a wellbore including a one-way flapper valve and a solids trap module as described above and positioned uphole of the one way flapper valve, is provided.

The wellbore may include an electric submersible pump located down hole of the solids trap module.

DETAILED DESCRIPTION

Figure 1A:
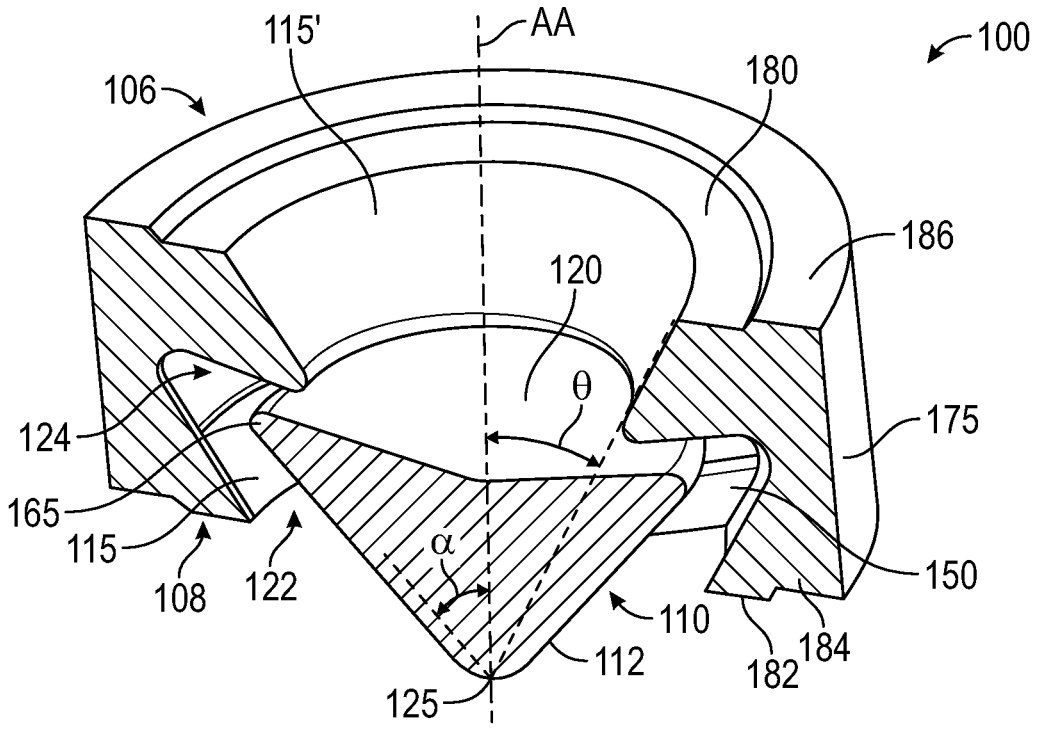
FIG. 1A shows a perspective, cross-sectional view of an illustrative solids trap module according to embodiments of the present disclosure.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Regarding the figures described herein, when using the term "down" the direction is toward or at the bottom of a respective figure and "up" is toward or at the top of the respective figure. "Up" and "down" are oriented relative to a local vertical direction. However, in well drilling industry, one or more activities may take place in a vertical, substantially vertical, deviated, substantially horizontal, or horizontal well. Therefore, one or more figures may represent an activity in deviated or horizontal wellbore configuration. "Uphole" may refer to objects, units, or processes that are positioned relatively closer to the surface entry in a wellbore than another. "Downhole" may refer to objects, units, or processes that are positioned relatively farther from the surface entry in a wellbore than another. True vertical depth is the vertical distance from a point in the well at a location of interest to a reference point on the surface.

Embodiments of the present disclosure provide a modular, static solids trap having no moving parts and enabling accumulation of solids in a solids buffer associated with the solids trap during periods where an electric submersible pump (ESP) is not operated, and the re-entrainment of the buffered solids into a flow created by the ESP upon re-initiation of operation of the ESP.

According to embodiments of the disclosure, fluid may be directed through a passage whose geometry allows the fluid to pass through at a desired rate in one direction, with any entrained solids being carried along with the flow. The passage includes changes to cross-section and/or geometry intended to cause changes in the velocity of the fluid flow. In a reverse flow situation (e.g., when the ESP stops operating) the fluid and any entrained solids may slow to below a sedimentation velocity of the solids where fluid changes direction, with the solids then settling out of the flow into the solids buffer. With the ESP under power a higher flow rate is again established so that the fluid velocity is sufficient to keep solids in suspension through the directional changes.

By providing such a system, solids may be prevented from backflowing to the ESP and/or a one-way valve paired with the ESP, without the use of moving parts. In addition, the buffered solids may be re-entrained into the flow without the use of moving parts simply by way of operation of the ESP.

Embodiments of the solids trap modules may have a revolved symmetry. Alternatively, solids traps according to the present disclosure may have any number of designs which are not symmetrical which function in a similar manner based on directional changes and obstructions in a fluid passage.

Figure 1B:
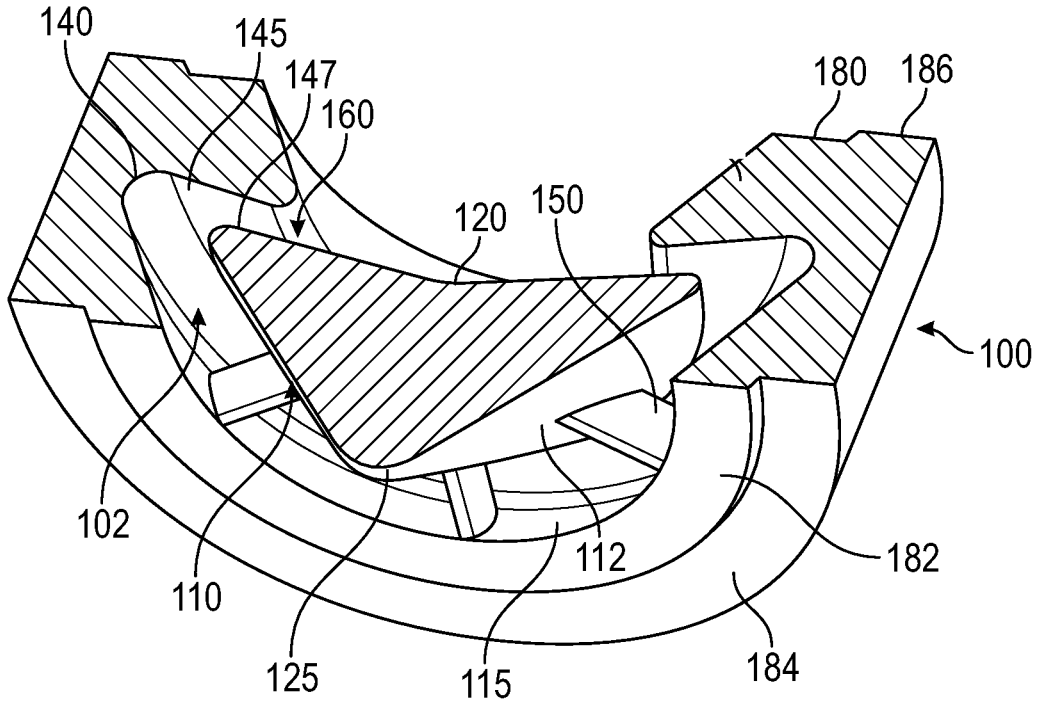
FIG. 1B shows another perspective, cross-section view of the illustrative solids trap module of FIG. 1A.
Figure 1C:
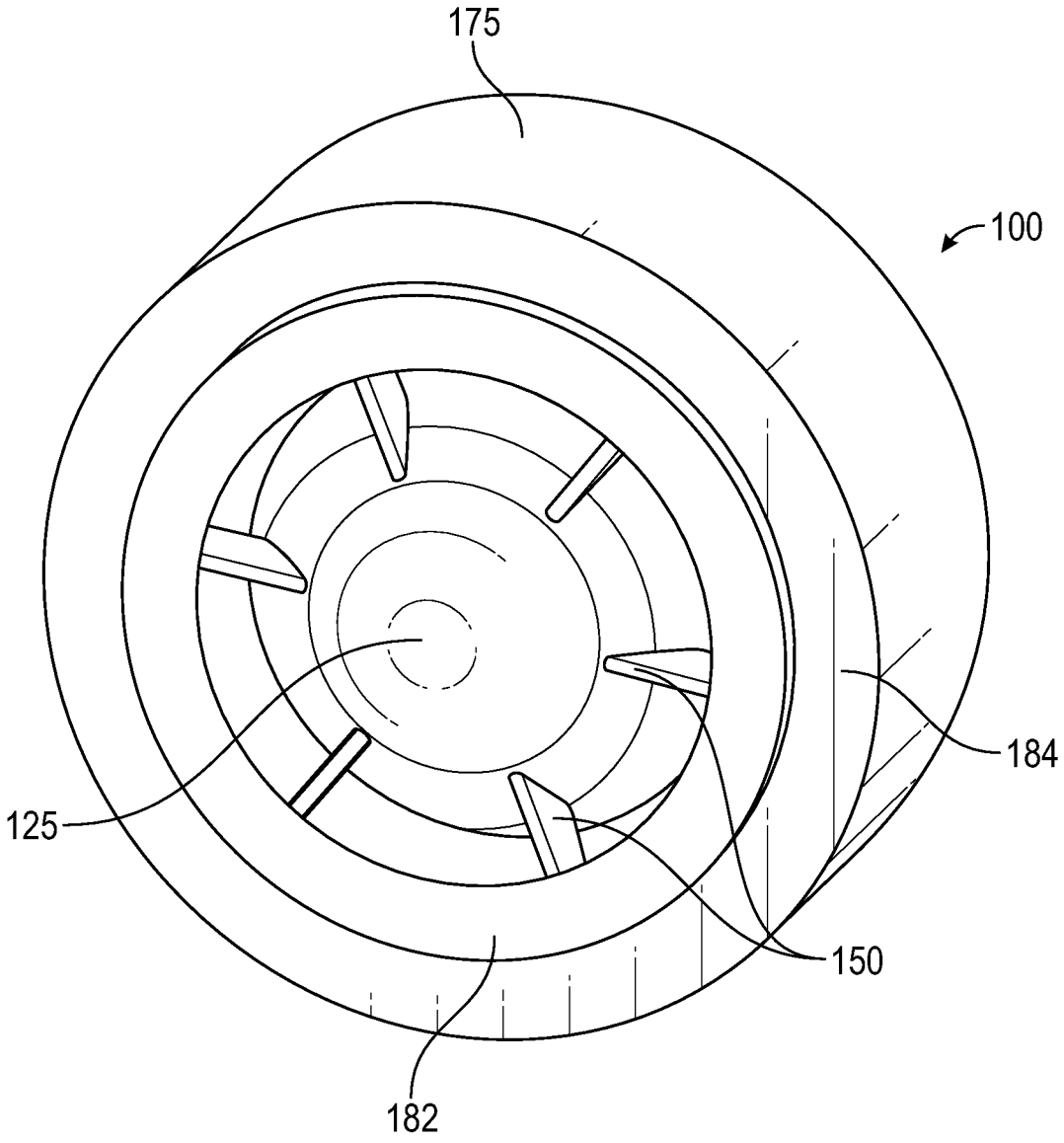
FIG. 1C shows a perspective view of the illustrative solids trap module of FIG. 1A.

FIG. 1A shows a perspective, cross-sectional view of an illustrative solids trap module 100 according to embodiments of the present disclosure, while FIGS. 1B and 1C shows other perspective views of the illustrative solids trap module 100.

The solids trap module 100 includes a flow modifier 110 having a solids buffer 120, and a body 175 defining an outer (exterior) portion and an inner (interior) portion of the solids trap module 100, among other things.

The body 175 may be fabricated from any suitable material based on, for example, a fluid to be pumped by an ESP. For example, the body 175 may comprise a thermoplastic, metal, composite, etc. and maybe fabricated by casting, injection molding, three-dimensional printing, machining, or any other method. The body 175 may be unitarily fabricated with the flow modifier 110, or components of the solids trap module 100 may be fabricated separately and assembled as desired.

The exterior surface of the body 175 may have a shape and size corresponding to a duct into which the solids trap module 100 is intended to be inserted and may present a top side 106 and a bottom side 108. For example, the body 175 may be substantially tubular and configured for insertion into production tubing of a fluid producing well, with the bottom side 108 being configured to be further downhole than the top side 106 when inserted. An external diameter of the body 175 may be sized to enable the solids trap module 100 to be inserted into and removed from the production tubing while also substantially preventing fluid flow bypassing the solids trap module 100 (e.g., fluid passing between the body 175 and a wall of the production tubing). In such embodiments, the production tubing may supply the desired pressure support for the assembled solids trap.

Alternatively, a solids trap comprising one or more solids trap modules 100 may be configured to be pressure retaining to enable installation along a segment of production tubing for a wellbore. In such embodiments, the solids trap modules 100 may be contained within a pressure retaining vessel and the vessel configured for affixing to the tubing, e.g., via threading, welding, etc.

Figure 1D:
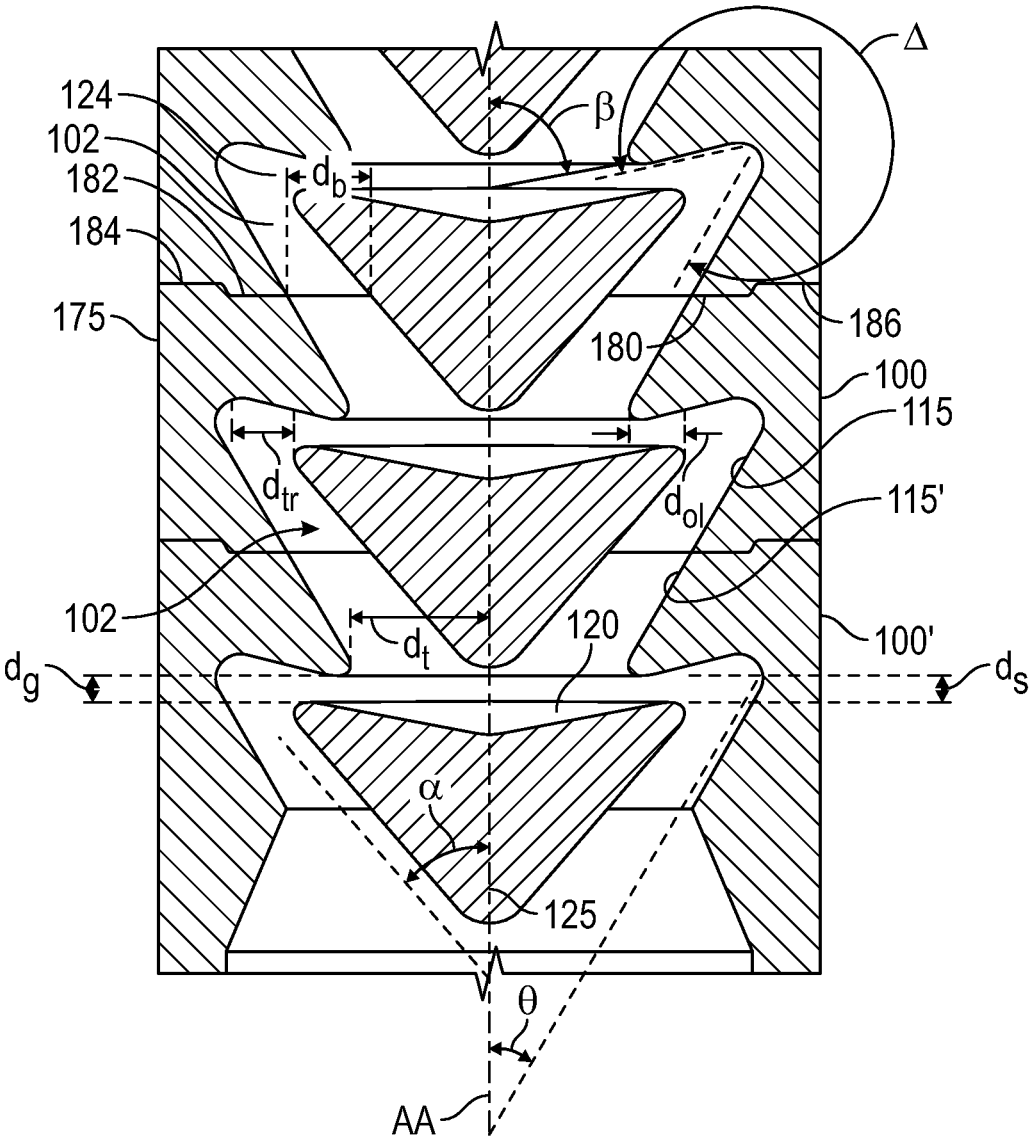
FIG. 1D shows a cross-sectional, plan view of a plurality of solids trap modules in a stacked configuration and forming a portion of an installed solids trap.

The body 175 may be configured as a modular component to enable assembly of two or more solids trap modules 100, in, for example, a stacked configuration. FIG. 1D shows a cross-sectional, plan view of a plurality of solids trap modules 100 in a stacked configuration and forming an installed solids trap. For example, a first solids trap module 100' may be inserted into production tubing of a well bore with the bottom side 108 of the body 175 coming to rest on a supporting structure, e.g., a shoulder 410 or other suitable support in the production tubing (sec, e.g., FIG. 4B). A second solids trap module 100 may then be inserted into production tubing with the bottom side 108 coming to rest and being supported on the top side 106 of the first solids trap module 100'. Any desired number of solids trap modules 100 may be stacked in such a manner, for example, between 4 and 10 solids trap modules. According to some embodiments, the number of modules may be determined based on the debris retaining capacity of each module and an anticipated volume of solids suspended within the fluid column. An additional factor of safety may also be applied for capturing a desired amount of solids. In addition, pressure drop across the trap, which increases proportionally to the number of modules, may be taken into consideration for a particular implementation, and minimization of the number of modules may be desirable.

According to some embodiments, the top surface 106 of each solids trap module 100 may be configured to engage with a bottom surface 108 of another solids trap module 100 to facilitate the stacking of solids trap modules 100. For example, each solids trap module 100 may include a register 180, 186 on the top surface 106 having a complementary shape to a register 182, 184 on the bottom surface 108 of another solids trap module 100. The register 180, 186 on the top surface 106 may include, for example, a raised portion 186 of a first width and a correspondingly formed recess 180 with a second width. The register 182, 184 on the bottom surface 108 may then include a raised portion 182 and a corresponding recess 184, wherein the position, thickness, and width of the recess 184 is configured to mate with the raised portion 186 on the top surface 106. Similarly, raised portion 182 of the bottom surface 108 may have a width, height, and thickness configured to mate with the recess 180, thereby facilitating alignment of the solids modules 100 in a stacked configuration. According to some embodiments, the registers may form concentric rings to enable concentric alignment of solids trap modules 100 when stacking.

According to further embodiments, the solids trap modules may include a geometric feature configured to angularly align the solids trap module 100 with another solids trap module 100. For example, a pin (not shown) protruding from a position on the raised portion 186 may be configured to engage with a similarly sized void positioned on the recess 184 to cause the angular alignment. These examples are not intended as limiting, and any suitable configuration of geometric features enabling such alignment are intended to fall within the scope of the present disclosure.

Returning to FIG. 1A, an interior of the body 175 may be substantially hollow allowing for a fluid to flow therethrough, the interior being defined by an interior wall 115, 115'. The interior wall 115, 115' defines a passage outer wall of a fluid passage 102 configured to direct, in part, a fluid flowing through the solids trap module 100. According to some embodiments, the passage outer wall 115, 115' may be positioned entirely within the interior of the body 175 for each solids trap module 100. Alternatively, depending upon a construction of solids trap module 100, a first portion of the passage outer wall 115 may be within the interior of the body 175 with a second portion of the passage outer wall 115' located on an exposed exterior portion, e.g., at a top side 106 of the solids trap module 100. In such a configuration, when the solids trap module 100 is stacked with another solids trap module 100 (see e.g., FIG. 1D), the passage outer wall 115 of the fluid passage 102 is formed by the combination of the passage outer wall 115 of a first solids trap module and the passage outer wall 115' of the second solids trap module 100. Throughout the description herein, the fluid passage 102 and its associated delimiting components (e.g., passage outer wall 115) will be interchangeably described in both stacked and singular configurations, and it is to be understood that the description is intended to refer to either configuration.

The passage outer wall 115 may be configured to control, at least in part, a flow of fluid within the solids trap module 100. The passage outer wall 115 may therefore include features to direct and redirect, in part, a flow of the fluid flowing within the solids trap module 100. For example, the passage outer wall 115 may extend in a first, non-parallel direction relative to an axial axis AA of the solids trap module 100. When considered in a cross-sectional plane taken through the axial axis AA of the solids trap module 100 (see e.g., FIG. 1D), the passage outer wall 115 may extend in the first, non-parallel, direction, at an angle $\theta$ ranging between, for example, about 20 degrees and 55 degrees as measured from a vertex formed by the outer wall 115 with the axial axis AA. For example, the passage outer wall 115 may extend from the axial axis AA at an angle $\theta$ of 45 degrees. The angles discussed herein are intended as illustrative and not limiting. Any suitable angles may be implemented such that the desired fluid flow velocity changes are obtained.

The passage outer wall 115 may extend at the angle $\theta$ for a desired distance along the axial axis AA of the solids trap module 100, and may change direction one or more times within the body 175. For example, at a position corresponding to approximately midway along the axial axis AA of a solids trap module 100, the passage outer wall 115 may change direction by an angle $\Delta$ relative to the passage outer wall 115 itself so as to extend at an angle $\beta$ relative to the axial axis AA of the solids trap module 100. The angle $\Delta$ may be configured such that the passage outer wall 115 causes fluid flowing through the solids trap module 100 to change direction as a result of resistance caused by the angular change of the passage outer wall 115. The angle $\Delta$ may range between about 280 degrees and 320 degrees. According to some embodiments the angle $\Delta$ may be 310 degrees.

The passage outer wall 115 may extend at the angle $\beta$ relative to the axial axis AA over a desired distance before again changing direction by an angle corresponding to negative $\Delta$. The passage outer wall 115 (or 115' depending on the configuration of solids module 100) thus extends from the axial axis AA at the original angle θ until the passage outer wall 115 reaches the top surface 106 of the solids trap 100.

At each transition in direction of the outer wall 115 the surface of the outer wall 115 may be filleted (i.e., rounded) to reduce or eliminate sharp edges and to aid in the transition of direction within the fluid passage 102.

The flow modifier 110 may be fabricated from any suitable material based on, for example, a fluid to be pumped by an ESP. For example, the flow modifier 110 may comprise a thermoplastic, metal, composite, etc. and maybe fabricated by casting, injection molding, three-dimensional printing, machining, or any other method. As noted above, according to some embodiments, the body 175 and the flow modifier may be unitarily fabricated, and thus of the same material. Alternatively, the body 175 may be fabricated separately from the flow modifier 110 and the two pieces subsequently assembled. According to such an embodiment, the body 175 and flow modifier 110 may be fabricated of the same or different materials.

The flow modifier 110 is configured to be positioned within the body 175 with a size and shape configured such that an outer surface 112 of the flow modifier 110 may cooperate with the passage outer wall 115 to form the fluid passage 102 of the solids trap module 100. In other words, the flow modifier and the passage outer wall 115 act to direct and redirect the flow of fluid in directional changes through the fluid passage 102 of solids trap module 100.

The flow modifier 110 may be shaped to present a desired cross-sectional profile for controlling a flow of fluid through the solids trap module 100 and for presenting the solids buffer 120 within the fluid passage 102. According to some embodiments, the flow modifier 110 may be formed as a cone (e.g., a rounded cone) having a base 165 and an apex 125, with the apex 125 being positioned downhole relative to the base 165. The term "base" as used herein, is intended to mean the substantially circular portion defining an external surface of a cone opposite the apex 125 of the cone, and not to refer to a vertical position of a portion. In other words, the base 165 may be further uphole than the apex 125 of the cone. For example, the flow modifier 110 may be a solid of rotation based on a curve having a slope corresponding to a desired taper of the flow modifier 110, where the slope can be measured as an angle α relative to the axial axis AA when the flow modifier is concentrically positioned within the body 175. The angle α may be determined based on a desired profile of the fluid passage 102 and may be configured such that cooperation between the passage outer wall 115 and the outer surface 112 of the flow modifier 110 cause a cross-sectional area change over a length of the fluid passage 102 for a first segment 122 of the fluid passage 102. For example, the angle α may range between about 25 and 65 degrees relative to the axial axis AA of the solids trap module 100.

According to some embodiments, the angle α may vary over the outer surface 112 of the flow modifier 110 to cause a desired change in flow characteristics of a fluid flowing in the fluid passage 102. For example, the angle α may increase progressively while moving in an uphole direction from the bottom surface 108 to the top surface 106 of the solids trap module 100. Such a configuration may allow a more desirable change in velocity and direction for fluid flowing during operation of the ESP.

Transitions from the outer wall 112 to the base 165 may be filleted (i.e., rounded) and the cap or tip of the cone may be spherical. For example, the fillets may have a radius of curvature in cross-section ranging between X1% and X2% of a height of the flow modifier 110, while a spherical cap 125 (also referred to as the apex) of the cone may have a radius of curvature in cross-section ranging between Y1% and Y2% of the height of the flow modifier 110. According to embodiments of the present disclosure, the radius of curvature may be selected according to the angles selected above to achieve a desired fluid flow velocity change while minimizing a pressure drop across the solids trap.

Within the body 175, the base 165 of the flow modifier 110 may be positioned uphole and toward the top surface 106 of the solids trap module 100 to enable the base 165 of the flow modifier 110 to act as the solids buffer 120. The based 165 may therefore, provide a portion of its surface which is overlapped by the passage outer wall 115.

The solids buffer 120 of the base 165 may be configured to facilitate buffering of solids that settle out of the fluid in the solids trap module 100. For example, the base 165 may be cupped or recessed to facilitate collection of solids falling out of the fluid as described below. A radius of curvature of the recess may be configured such that the solids trap 120 may buffer a predetermined amount of solids before becoming "full" and causing subsequently settle solids to pass to a solids buffer 120 further downhole.

Additionally, the base 165 may include one or more surface modifiers configured to facilitate accumulation of solid particles settling out of the fluid during period of non-operation by the ESP. For example, the base 165 may include or more of a chevron, a rib, a serration, scales, and a dimple on the outer surface of the base 165. Depending on an orientation of the surface modifiers, holding of solids particles settled on the solids buffer 120 during periods when the ESP is not operating may be improved, while re-entrainment of the same particles during operation of the ESP may be facilitated. For example, a plurality of dimples may be provided on a portion of the outer surface of the base 165 in an area where re-entrainment is desired such that turbulence can be induced in the fluid flow and drag reduced. This may enable an increase in velocity in the re-entrainment area. In another example, where a greater reduction in velocity is desired, surface features increasing drag may be introduced on the outer surface of the base 165.

The flow modifier 110 may be supported within the body 175 via any suitable manner. For example, one or more ribs or spokes 150 may be provided between the flow modifier 110 and the passage outer wall 115 of the body 175, thereby affixing the flow modifier 110 within the body 175. The spokes 150 may be unitarily formed with the body 175 and the flow modifier 110 such that each solids trap module 100 is one single piece. Alternatively, the spokes 150 may be adhered to the outer passage wall 115 and the flow modifier 110 via overmolding, an adhesive, a welding, etc.

According to some embodiments, the spokes 150 may be straight and configured to minimize resistance to a flow of fluid within the solids trap module 100. Alternatively, the spokes 150 may be provided with a profile configured to produce additional changes in the flow of fluid through the solids trap module 100. For example, the spokes 150 may be configured with a profile similar to an airfoil, the profile being configured to induce rotation in the fluid flow. Solids trap modules 100 including profiled spokes 150 may be interspersed or interchanged with solids trap modules 100 including flat spokes to provide varying levels of fluid flow modification through the solids trap module 100.

Figure 2A:
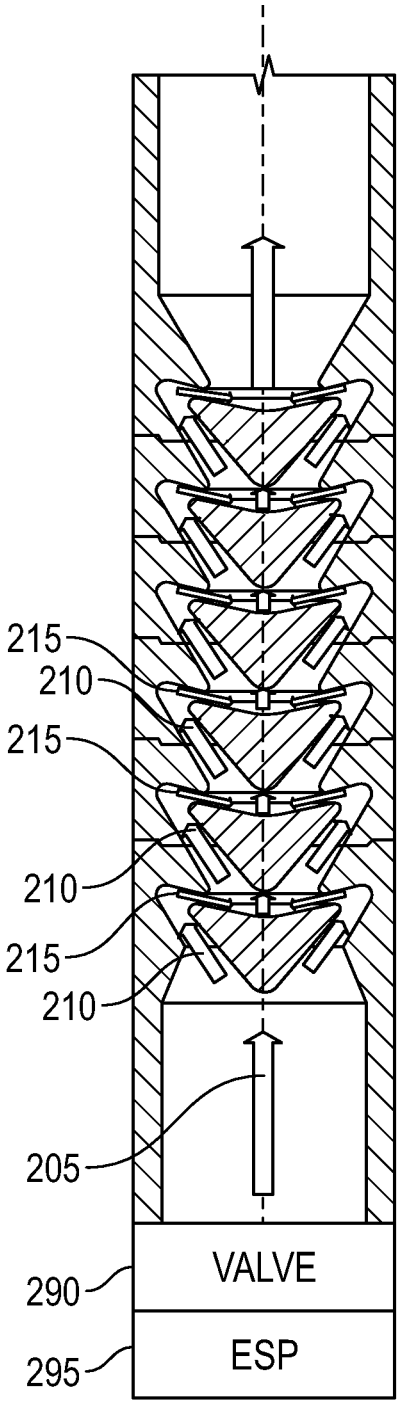
FIG. 2A shows an installed solids trap according to embodiments of the disclosure during operation of an electric submersible pump (ESP)

Returning to FIG. 1D, illustrative geometries associated with the fluid passage 102 when the flow modifier is positioned within the body 175 will now be described in conjunction with FIGS. 2A and 2B. As noted above, the flow modifier 110 and the passage outer wall 115 are configured to cooperate to change characteristics (e.g., direction, velocity, pressure) of the fluid flowing in the fluid passage 102 based on whether an ESP 295 is currently operating or not. When the ESP 295 is operating the fluid flows through the solids trap modules 100 in the uphole direction as shown in FIG. 2A by the flow indicating arrows 205. In contrast, when the ESP 295 stops operating (e.g., due to a power outage or other issue), the fluid flows through the solids trap modules 100 in the downhole direction, as shown by the arrows 255 at FIG. 2B.

The fluid flowing uphole through the fluid passage 102 during ESP operation is caused to flow around each flow modifier 110 upon encountering the obstruction formed thereby in the solids trap module 100 as shown by arrows 210. In a first segment 122 of the fluid passage 102, the distance $d_b$ between the outer wall 112 of the flow modifier 110 and the passage outer wall 115 at the bottom surface 108 of the solids trap module is greater than the distance $d_{tr}$ between the outer surface 112 of the flow modifier 110 and the passage outer wall 115 at the base 165 of the flow modifier 110. Thus, a cross-sectional flow area of the first segment 122 at a point nearest the axial axis AA of the solids trap 100 is greater than a second cross-sectional flow area of the first segment 122 at a second point furthest from the axial axis AA of the solids trap 100. A fluid flowing uphole through the first segment 122 of the fluid passage 102 (e.g., during ESP operation) is therefore accelerated with pressure dropping at the approach to the redirection caused by the passage outer wall 115 turning at the angle Δ.

The fluid flowing uphole is redirected through a second segment 124 of the fluid passage 102 by the passage outer wall 115 as shown by arrows 215. According to some embodiments, the passage outer wall 115 is configured to overlap the solids buffer 120 by an overlap distance $d_{ol}$ thereby causing the fluid to flow through a gap 160 having a width of $d_g$ formed between the passage outer wall 115 and the solids buffer 120 at a directional transition point of the passage outer wall 115. A first cross-sectional flow area of the second segment 124 at a point nearest the axial axis, i.e., at the gap 160, of the solids trap 100 is smaller than a cross-sectional flow area of the second segment 124 at a point furthest from the axial axis of the solids trap, i.e., at the junction between the base 165 and the outer surface 112 of the flow modifier 110. In other words, a flow restriction is created by way of the distance $d_g$ at the gap 160 being less than the distance $d_s$. Fluid flowing uphole through the second segment 124 is thus further accelerated, and the additional velocity of the fluid may cause solids present on the solids buffer 120 to be re-entrained into the fluid flow passing over the solids buffer 120, and carried further uphole, ultimately to be pumped out of the wellbore at the surface.

Figure 2B:
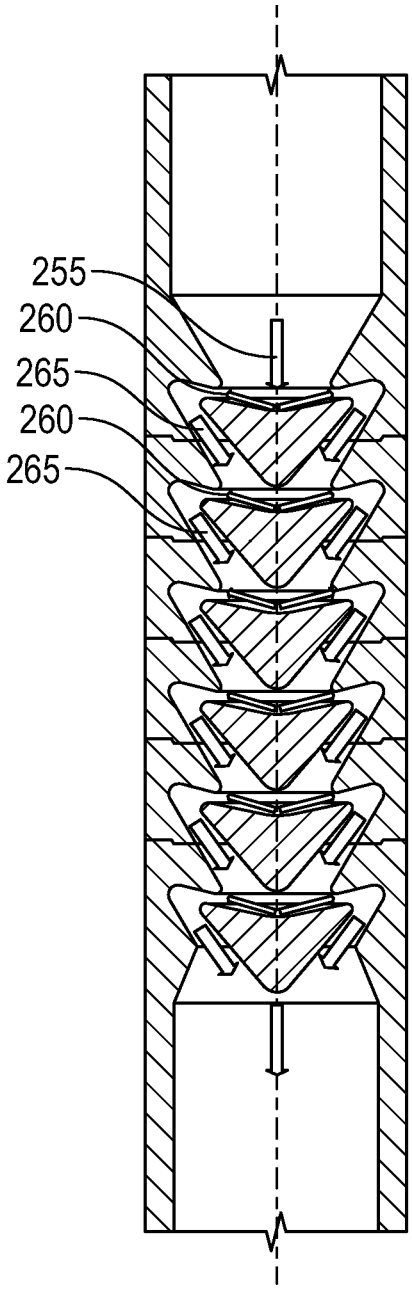
FIG. 2B shows an installed solids trap according to embodiments of the disclosure during a period after an ESP has stopped operation.
Figure 3:
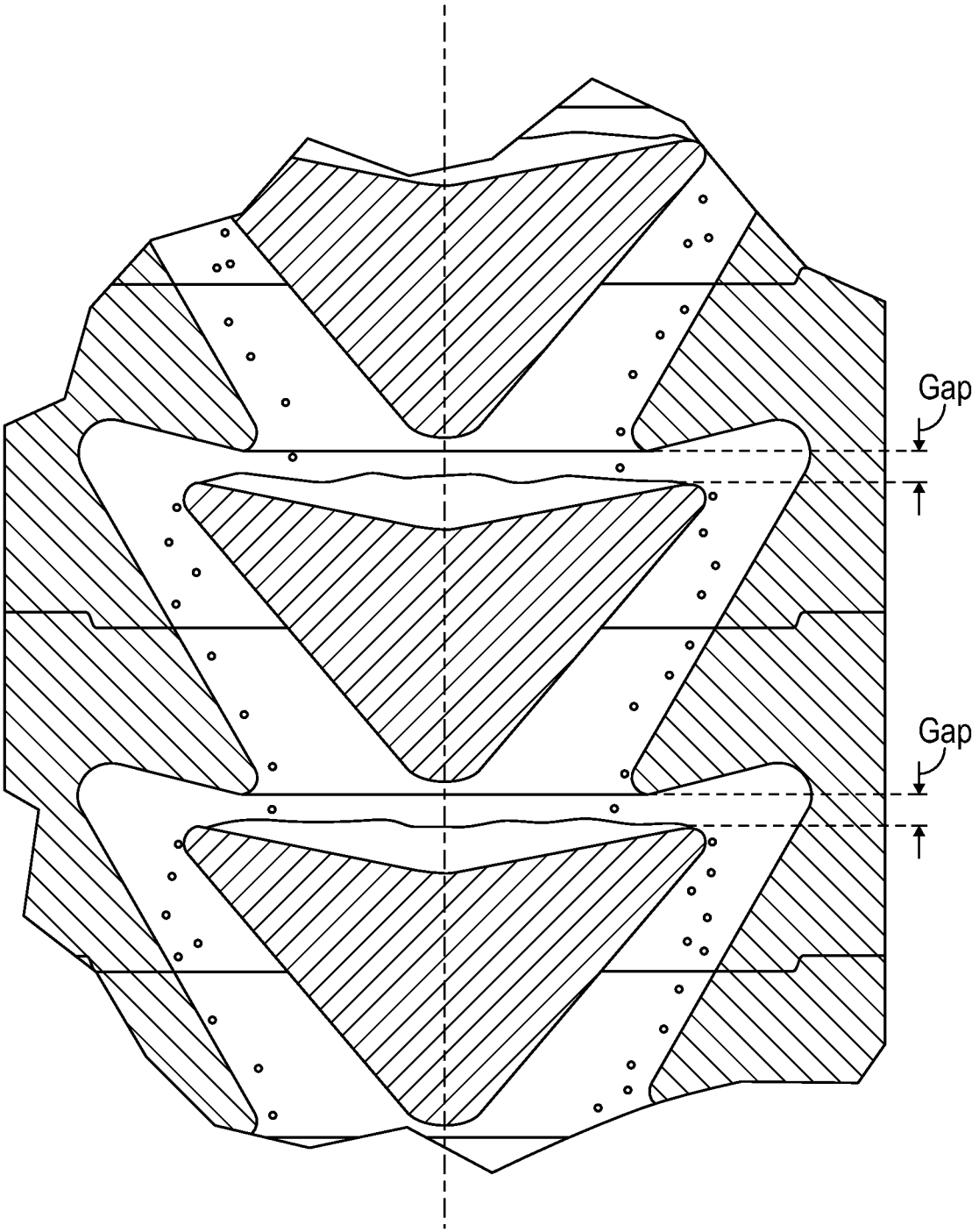
FIG. 3 highlights solids accumulation by an illustrative solids trap during a period after an ESP has stopped operating.

When the ESP 295 stops operating (e.g., due to a power outage or production stoppage), the fluid in the production tubing begins to flow downhole as shown by the arrows 255 at FIG. 2B. Flow resistance in the downhole direction is generally increased as a result of the geometry provided, and the fluid decelerates upon encountering the flow obstructions created by the solids buffer 120 and the gap 160. As the fluid loses velocity a sedimentation velocity may be reached for certain solids particles within the fluid flow, and these particles may settle out of the fluid onto the solids buffer 120, see, e.g., FIG. 3.

The fluid is redirected to flow through the second segment 124 by the solids buffer 120 and the passage outer wall 115 as shown by arrows 260. Based on the geometry described above with regard to the gap 160 and the second segment, the fluid is further decelerated through the second segment 124, both by way of redirection and interference with fluid flowing downhole.

The fluid is subsequently redirected to the first segment 122 as shown by arrows 265 as a result of the change in direction of the passage outer wall 115, and further decelerated based on the widening cross-sectional flow area of the first segment 122. This may then cause sedimentation velocity to be reached for a substantial portion, if not all of the solids present in the fluid flow. The solids therefore, settle to the solids buffer 120. As a solids buffer becomes unable to retain further solids, the settling solids may carryover to a subsequent solids buffer 120 until the ESP 295 begins to operate again.

The geometries associated with the solids trap modules 100 described herein are illustrative and not intended to be limiting. Any suitable geometries may be implemented to impart the directional changes desired to a fluid flow to enable settling and re-entrainment of solids in the fluid.

Solids trap modules 100 according to embodiments of the present disclosure may be installed within production tubing or inserted as part of the production tubing for a well bore. The solids trap modules 100 may be positioned uphole of the ESP 295 and, where provided, uphole from a one-way flapper valve 290 configured to reduce backflow through the ESP 295.

Figure 4A:
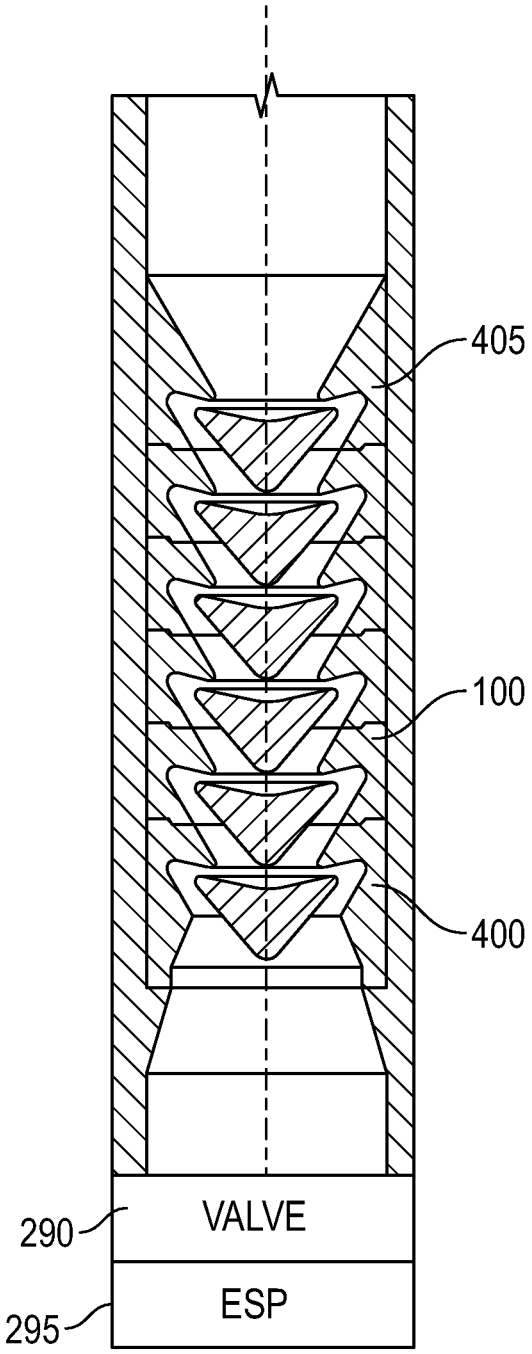
FIG. 4A shows an illustrative modular solids trap in an installed position in production tubing of a fluid well.

FIG. 4A shows an illustrative modular solids trap in an installed position in production tubing of a fluid well. As noted above, the solids trap modules 100 can be installed in a stacked configuration within production tubing of a wellbore. In such a configuration a "starter" module 400 may be placed in the production tubing first, the starter module 400 including a foundation portion 402 configured to provide an offset between the flow divider and the shoulder 410. The foundation portion 402 may be shaped as desired, for example, tapered to cause a change in the fluid flowing to the solids trap module 100. The foundation portion 402 may also provide support for the solids trap 100 as regards the shoulder 410 as well as facilitating removal of the solids trap 100 from the wellbore for example, for servicing.

Figure 4B:
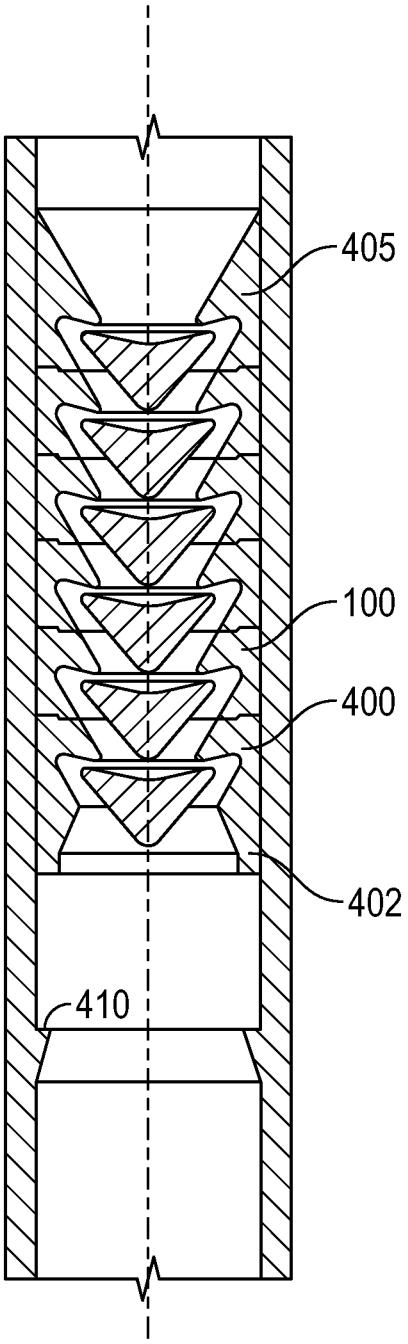
FIG. 4B shows the illustrative modular solids trap of FIG. 4 during a removal process from the production tubing of the fluid well.

FIG. 4B shows the illustrative modular solids trap of FIG. 4 during a removal process from the production tubing of the fluid well. The foundation portion 402 may include one or more connectors (not shown) enabling a fishing system to connect to the foundation portion and to lift the solids trap modules 100 out of the wellbore via upward force exerted on the foundation portion 402.

In addition, a capping solids trap module 405 may be provided at the top of a stack of solids trap modules 100 within the wellbore. The capping solids trap module 405 may include one or more features (e.g., tapered sides) to facilitate a desired change in the fluid exiting or entering the solids trap modules 100. For example, a bore diameter change may be implemented by tapering the walls of the capping solids trap module 405 in a desired direction prior to encountering the solids buffer 120 and the second segment 122.

One of skill in the art will recognize upon review of the present disclosure that the solids trap may be inserted in any fluid producing wellbore to protect downhole equipment from solids intrusion.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A solids trap module for an electrical submersible pump (ESP) of a wellbore, comprising:

a body;

a flow modifier configured to be a solid obstruction positioned axially within the body and statically affixed to the body via one or more ribs or spokes, wherein an uphole-facing surface of the flow modifier forms a solids buffer, wherein the flow modifier is in the form of a rounded cone, an apex of the rounded cone having a spherical cap positioned downhole and a base of the rounded cone forming the solids buffer; and a fluid passage defined by an inner surface of the body and an outer surface of the flow modifier, the fluid passage comprising:

a first segment configured to redirect a fluid flowing through the solids trap module in a first angular direction relative to an axial axis of the solids trap module to form a redirected fluid flow; and a second segment, fluidly connected to the first segment, configured to redirect at least a portion of the redirected fluid flow in a second angular direction different than the first angular direction to pass over at least a portion of the solids buffer, wherein, when the ESP is not operating, the first segment, the second segment, the body, and the flow modifier are configured to cooperate to cause settling of solids entrained by the fluid onto the solids buffer of the flow modifier as the fluid flows downhole through the solids trap module, and wherein, when the ESP is operating, the first segment, the second segment, the body, and the flow modifier are configured to cooperate to cause the solids settled on the solids buffer to be re-entrained into the fluid as the fluid flows uphole through the solids trap module.

2. The solids trap module of claim 1, wherein a first cross-sectional area of the second segment at a first point nearest the axial axis of the solids trap module is smaller than a second cross-sectional area of the second segment at a second point furthest from the axial axis of the solids trap module.

3. The solids trap module of claim 1, wherein a first cross-sectional area of the first segment at a first point nearest the axial axis of the solids trap module is greater than a second cross-sectional area of the first segment at a second point furthest from the axial axis of the solids trap module.

4. The solids trap module of claim 1, wherein the solids buffer comprises a recess configured to accumulate settled solids.

5. The solids trap module of claim 1, wherein the one or more ribs or spokes affix the rounded cone to the inner surface of the solids trap module.

6. The solids trap module of claim 5, wherein at least one of the one or more ribs or spokes are configured to impart rotation to the fluid flowing through the solids trap module.

7. The solids trap module of claim 1, wherein a first external surface of the solids trap module is configured to engage with a second external surface of a second solids trap module to enable stacking of the solids trap module with another solids trap module.

8. The solids trap module of claim 7, wherein the solids trap module comprises a first register having a complementary shape to a register of the second solids trap module, and configured to concentrically align the solids trap module with the second solids trap module in a stacked configuration.

9. The solids trap module of claim 1, wherein the solids trap module comprises a geometric feature configured to angularly align the solids trap module with another solids trap module.

10. The solids trap module of claim 1, wherein the solids trap module is unitarily formed by one of casting, injection molding, and three-dimensional printing.

11. A wellbore, comprising:

a one-way flapper valve;

the solids trap module according to claim 1 positioned uphole of a one way flapper valve.

12. The wellbore according to claim 11, further comprising: an electric submersible pump located down hole of the solids trap module.

* * * * *